United States Patent [19]

Nagaoka

[11] Patent Number: 4,501,568

[45] Date of Patent: Feb. 26, 1985

[54] SHUTTLE WHEEL TOY

[75] Inventor: Muneo Nagaoka, Tokyo, Japan

[73] Assignee: I & K Trading Company, Washington, D.C.

[21] Appl. No.: 528,800

[22] Filed: Sep. 2, 1983

[30] Foreign Application Priority Data

Jul. 28, 1983 [JP] Japan ..... 58-136700

[51] Int. Cl.[3] ..... A63H 33/02

[52] U.S. Cl. ..... 446/450; 446/438; 446/441; 446/444; 446/447; 200/252

[58] Field of Search ..... 46/62, 65, 202, 236, 46/228, 241, 220, 60; 273/1 M, 109; 272/8 M; 104/94; 200/252

[56] References Cited

U.S. PATENT DOCUMENTS

| | | | |
|---|---|---|---|
| 1,005,853 | 10/1911 | Lewis | 46/241 |
| 2,263,754 | 11/1941 | Batcheller | 200/252 |
| 2,613,476 | 10/1952 | Metz | 46/220 |
| 3,430,381 | 3/1969 | Phipps | 46/65 |
| 3,466,796 | 9/1969 | Greenblatt | 46/241 |
| 3,826,497 | 7/1974 | Thomason | 273/109 |
| 3,919,946 | 11/1975 | Laurent | 104/94 |
| 4,031,660 | 6/1977 | Chen | 46/241 X |

FOREIGN PATENT DOCUMENTS

| | | | |
|---|---|---|---|
| 2223900 | 9/1973 | Fed. Rep. of Germany | 46/138 |

*Primary Examiner*—Robert A. Hafer
*Assistant Examiner*—Daniel Nolan
*Attorney, Agent, or Firm*—John J. Byrne; Bradford E. Kile; Kevin M. O'Brien

[57] ABSTRACT

A shuttle wheel toy comprising a rotary wheel having a magnetized rotation shaft extending through a central portion of the wheel to have ends protruded beyond side walls of the wheel and mounted across a pair of substantially parallel arranged rails secured at one end respectively thereof in a grip, which may be gripped by a hand to axially sway the rails to thereby let the rotary wheel rotate and run on the rails which provide for a path of reciprocation to the wheel. Through a battery housed in the grip and the rails functioning as a positive and a negative electrodes, an illumination element housed in the rotary wheel can be energized to light.

5 Claims, 10 Drawing Figures

SHUTTLE WHEEL TOY

BACKGROUND

This invention relates to a shuttle wheel toy of which the wheel can be rolled and shuttled manually on a pair of virtually parallel U-shaped rails, and more particularly, a shuttle wheel toy wherein the shuttle wheel can be lighted with an electric light while it rotates.

Heretofore, there has been a toy of the structure in which basal parts of a pair of virtually parallel U-shaped rails are planted in an end of a grip and a shuttle wheel equipped with a magnetic shaft is mounted on the rails, and which is played with by letting the shuttle wheel roll to run on the rails, back and forth.

With the conventional shuttle wheel toy, the motion allowed of its shuttle wheel is too simple to sufficiently please the player, and in addition, this toy is little attractive visually in that it is poor in visual changes; consequently, the disadvantage is that this toy will soon lose interests of children who have learned how to play with it.

SUMMARY

An object of the present invention is to provide a shuttle wheel toy wherein the shaft of a shuttle wheel is attracted on a pair of essentially parallel U-shaped rails by magnetic force and the shuttle wheel can be rolled and shuttled manually on the rails, whereas the shuttle wheel is caused to offer visual variations, so that children can play with this shuttle wheel toy without soon getting tired of it.

In order to accomplish the above object according to the present invention, the shuttle wheel toy is characterized in that there are provided a battery detachably contained in a grip in which a pair of substantially parallel rails are planted, the electrodes of the battery being connected to the two rails through an ON/OFF alteration switch at least between one of the electrodes and the rail; and a lamp housed in the shuttle wheel proper, both terminals of the lamp being connected to the conductive rotation shaft of the shuttle wheel set across the two rails in such a manner as to prevent shorting between them.

THE DRAWINGS

PREFERRED EMBODIMENTS

Figure 1:
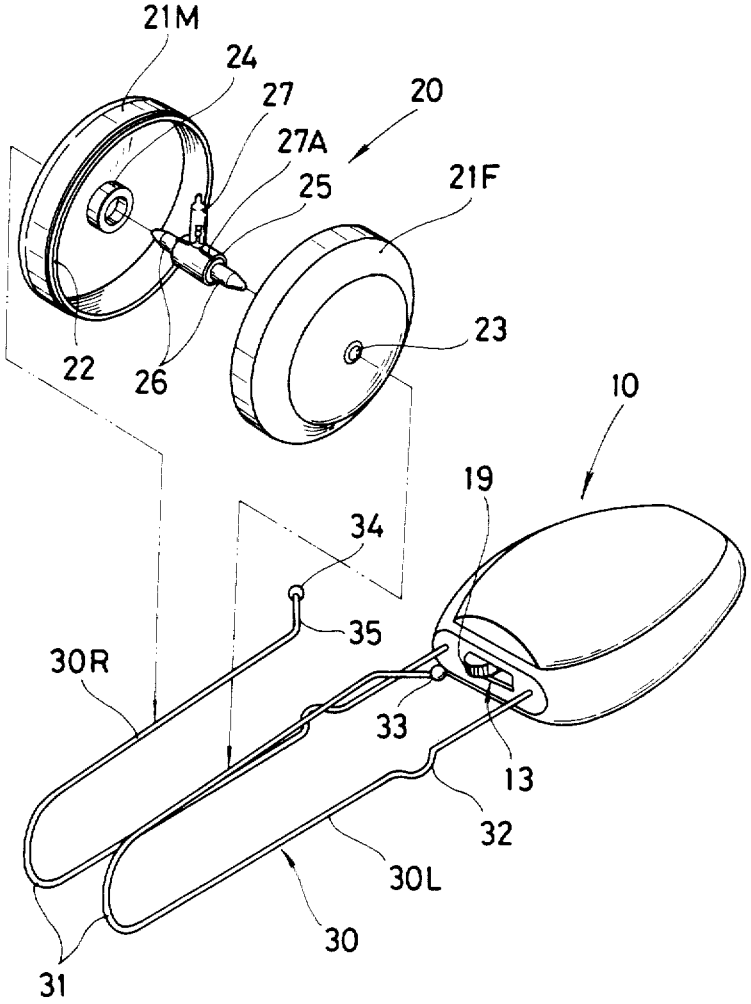
FIG. 1 is a perspective assembly view, illustrating a shuttle wheel toy according to an embodiment of the present invention.
Figure 2:
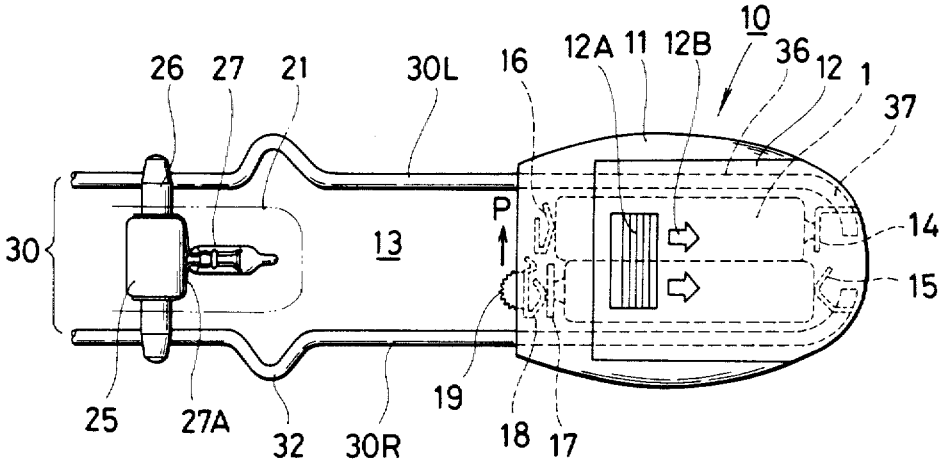
FIG. 2 is a bottom view illustrating the construction of the grip shown in FIG. 1.

FIG. 1 is a perspective assembly view illustrating a shuttle wheel toy according to a first embodiment of the present invention and the construction of its wheel. FIG. 2 is a bottom view, illustrating the inside structure of the grip 10 in which two rails 30 have been planted.

In this example, two equally long right rail 30R and left rail 30L are planted in the grip 10 and these rails 30R and 30L are folded up halfway at the turn 31. A safety ball 34 is attached to a free end 33, and a portion close to the free end is outwardly extended so as to form a free end extension 35. In addition, a portion of the rail 30 close to the grip 10 is outwardly curved to form a gulf as an extension 32. The above extensions 32 and 35 are used to make a shuttle wheel 20 to be moved on the rail turn round.

In a portion 36 within the grip 10 for fixing the rail 30, a bend 37 is made at the end of the rail as shown in FIG. 2 to prevent it from rotating, so that the left and right rails 30 may always be fixed in parallel with each other. Moreover, cells 1 (two cells of UM-3 type) are contained in the grip 10, the anode of the cell 1 being connected to the left rail 30L via a positive terminal 14, the cathode of the cell 1 being connected to the right rail 30R via a negative terminal 15. These two cells 1 are so arranged that they can be connected and separated.

A switch 13 in this example comprises a fixed contact 16 connected to the cathode of the cell 1, a fixed contact 17 connected to the other cell 1, and a traveling contact 18 connecting these fixed contacts 16 and 17 together as the contact 18 slides. The traveling contact 18 is provided with a knob 19 projected outwardly from the casing 11 of the grip 10. Accordingly, if the knob 19 is slid toward the P direction (ON direction) shown by an arrow, the two cells 1 are connected in series, so that the right and left rails 30R and 30L are negatively and positively charged, respectively. The numeral 12 denotes an underside cover installed on the bottom surface of the casing 11 and, if a corrugated portion 12A is pushed and slid by the finger in the direction marked with arrows 12B provided on the underside cover 12, the cover can be removed so that the cells 1 may be taken out for replacement, for example.

On the other hand, regarding the wheel 20 to be rolled and shuttled on the rail 30 according to the oscillation of the grip 10, its casing proper 21 made of light-permeable colored synthetic resin comprises a male casing 21M having an interlocking ring projection 22 and a female casing 21F to be engaged therewith, different coloration being provided for both of them. A lead 27A of a lamp 27 as a light emission element is connected to each of the magnetized conductive iron rotary shafts 26 fixedly attached to the ends of a magnet 25. The male and female casings 30F and 30M are then combined together by inserting the rotary shaft in the hole made in the casing in a manner such that the shaft is protruded from the hole. A rib 24 is used to position and hold the magnet 25 within the casing proper 21.

In the shuttle wheel toy thus constructed according to the present invention, if the grip 10 is oscillated after the knob 19 of the switch 13 is slid in the ON direction, the wheel 20 will be reciprocally rolled on the rail 30 while the lamp 27 is being lighted, and the light emitted by the lamp 27 can be visually recognized from the outside through the light-permeable casing proper 21. Moreover, since the light emission point of the lamp 27 is separately positioned from the rotary shaft, the locus of the light emission point depicts a trochoid as the wheel rotates, thus making the shuttle wheel toy highly effective in giving visual variations to those playing with it.

Figure 3:
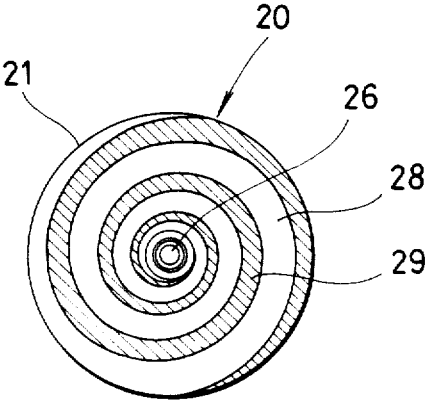
FIG. 3 is a side view of a modified wheel according to the present invention.

FIG. 3 illustrates another exemplary embodiment of the present invention, modified in the form of the wheel 20. In this example, the casing 21 is provided with scrolls 29 on its left and right side surfaces so as to increase the visual variations as the wheel 20 rotates on the rail 30. If the direction of rotation of the wheel 20 is changed, it will effectively hallucinate one as if the whirl were about to spring out or as if one were engulfed therein.

Figure 4:
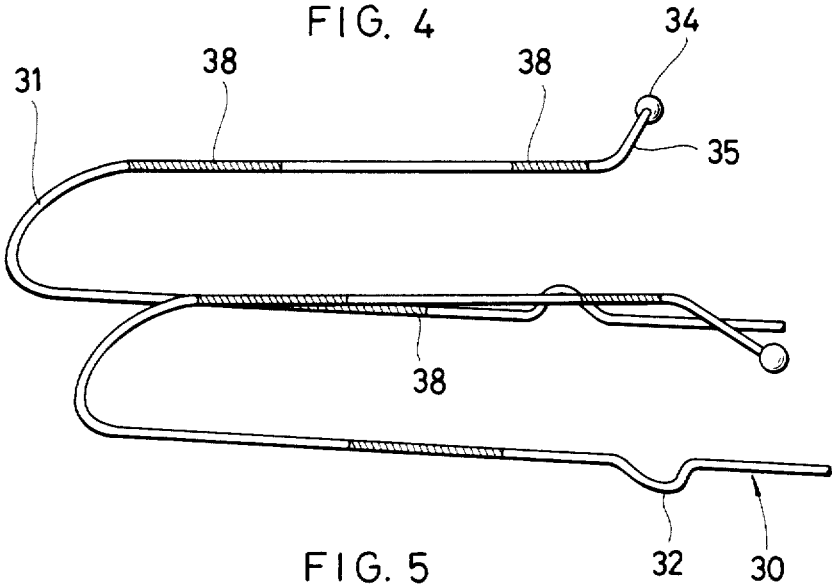
FIG. 4 is a schematic view of a modified rail according to the present invention.

FIG. 4 illustrates another exemplary embodiment of the present invention, modified in the form of the rail 30. In this example, the rail 30 is provided with insulated portions 38 at places. If the rail 30 has the insulated portions in this way, current is not allowed to flow through the lamp 27 of the wheel 20 when the rotary shaft 21 of the wheel 20 passes on the insulated portion 38 and the lamp 27 is turned off. As a result, if the rotating speed of the wheel 20 on the rail 30 is increased by adjusting the oscillation of the grip 10, the wheel will look as if it is flashing when reciprocally shuttling. This also effectively increases visual variations. Although the insulated portions 38 have been provided in the same positions on the left and right rails 30L and 30R in this case, the similar effect will be obtainable even though the insulated portions 38 are provided on either rail 30. The insulated portions 38 may be provided by winding a tape thereon or applying an insulating material thereto.

Figure 5:
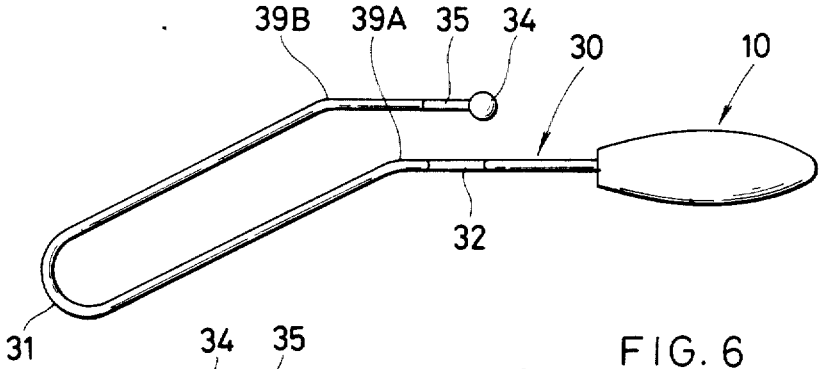
FIGS. 5 and 6 are side views, showing a third and a fourth examples of the rail according to the invention.
Figure 6:
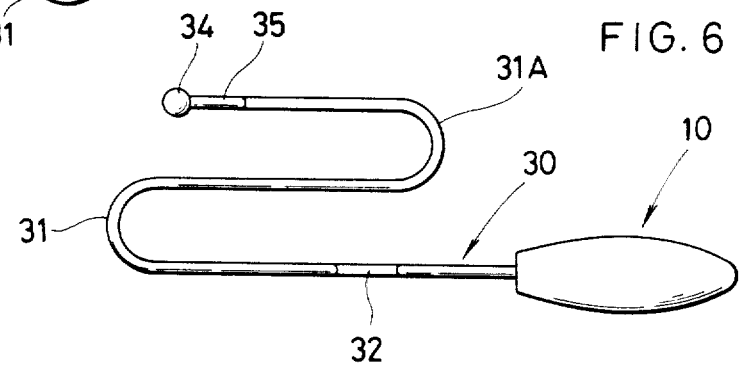

FIGS. 5 and 6 illustrate a third and a fourth examples of the rail 30. In these examples, the shape of the rail 30 is made complicated by bending or folding back the rail at least once in a place other than the folding back portion 31. In other words, a first bend 39A and a second bend 39B are added to the rail 30 in the third example in FIG. 5, whereas a second folding back portion 31A is added to the rail 30 in the fourth example in FIG. 6. The shape of the rail 30 thus complicated makes the moving locus of the wheel 20 intricate while increasing visual variations further, whereby the player with the toy will not become tired of playing with because the operation of oscillating the grip becomes also complicated.

Figure 7:
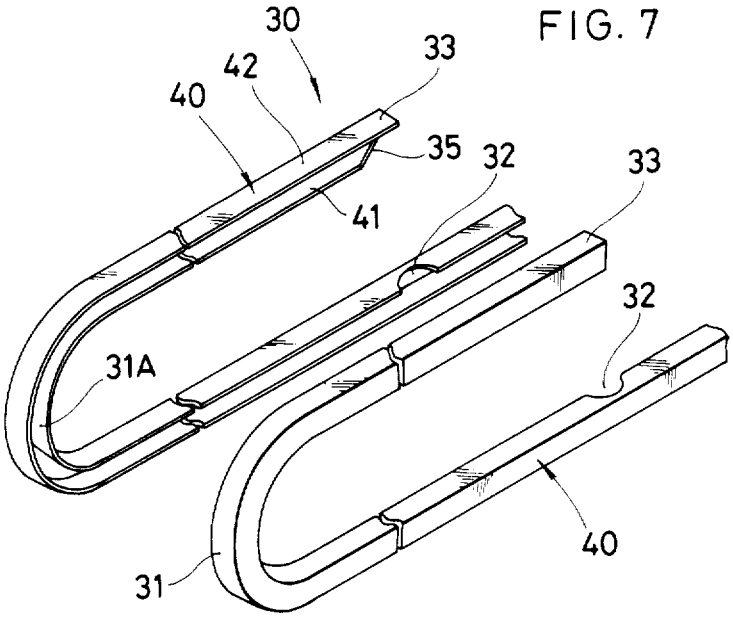
FIG. 7 is a schematic view of a fifth example of the rail according to the invention.

FIG. 7 illustrates a fifth example of the rail 30. In this example, channel steel 40 is used as the rail 30 by making openings face each other. The extension 32 and the free extension 35 are provided only for an inner wall 41 of the channel steel 40 and not for an outer wall 42. In other words, the inner wall 41 of the channel steel 40 is used as the rail 30 in this example and the outer wall 42 is used as a guard for preventing the rotary shaft 26 of the wheel 20 from springing out when the rotary shaft 26 moves on the surface of the inner wall 41 close to the outer wall 42 side. Accordingly, even when the wheel 20 is disengaged from the inner wall 41 in the folding back portion 31A of the inner wall 41 by abruptly swinging the grip 10 while the rotary shaft 26 of the wheel 20 is being attracted to the outer wall 42 side of the inner wall 41, the wheel 20 is prevented from springing out because the rotary shaft 26 is engaging with the outer wall 42.

Figure 8:
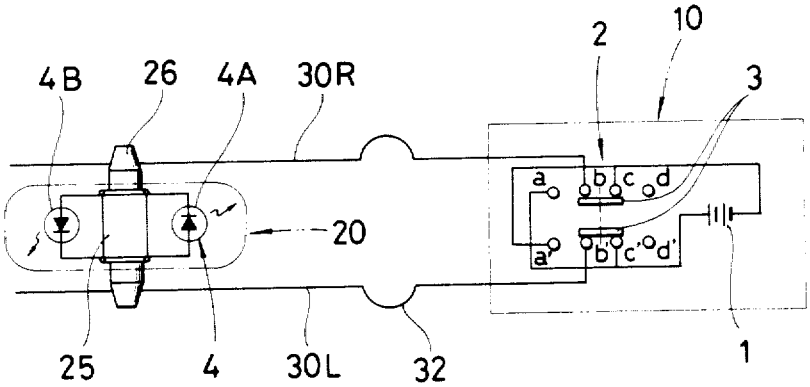
FIG. 8 is an electric circuit diagram illustrating the electrical construction of another embodiment of the shuttle wheel toy according to the invention.

FIG. 8 illustrates another embodiment of the present invention, wherein only an electrical arrangement is shown. In this example, a LED 4 is used as a light emission element contained in the wheel 20; two LED's 4A and 4B emitting light different in color and having different polarity are installed across the rotary shafts 26. On the other hand, a polarity changeover switch 2 is contained in the grip 10, so that the connection of the anode and cathode of the cell 1 to the right rail 30R and the left rail 30L can be changed over. For this reason, the switch 2 used is of such a type that, for instance, two traveling contacts 3 which interlockingly actuate two series of four contacts a, b, c, d, a', b', c', d', are employed to realize the switching operation: The contacts a, c', and a', c being connected to the anode and cathode of the cell 1, respectively; the contact d, d' being left unconnected; the contacts b and b' being connected to the right rail 30R and the left rail 30L, respectively.

Thus, when the traveling contacts 3 connect the contacts b and c, and the contacts b' and c', the LED 4A lights because the left rail 30L is positively charged and the right rail 30R is negatively charged, whereas when the traveling contacts 3 connect the contacts a and b and the contacts a' and b', the LED 4B lights because the left rail 30L is negatively charged and the right rail 30R is positively charged. The contacts d and d' are used not to allow the LED's 4A and 4B to light.

Consequently, the switch 2 in this example is used to change the LED's 4 to be lighted and therefore luminous colors, thus effecting visual variations.

Figure 9:
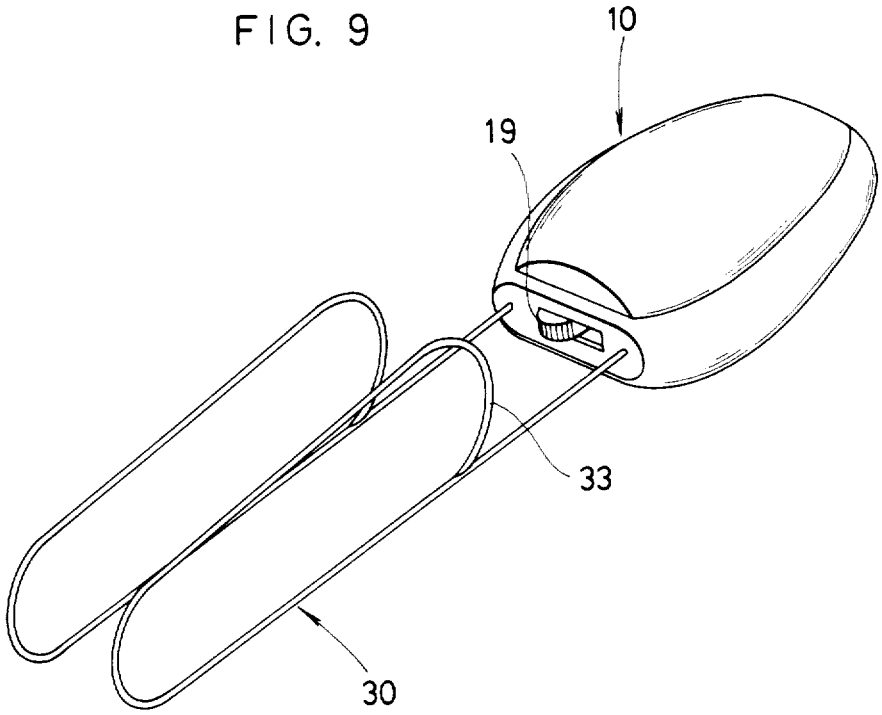
FIG. 9 is a schematic view, illustrating a sixth example of the rail according to the invention.
Figure 10:
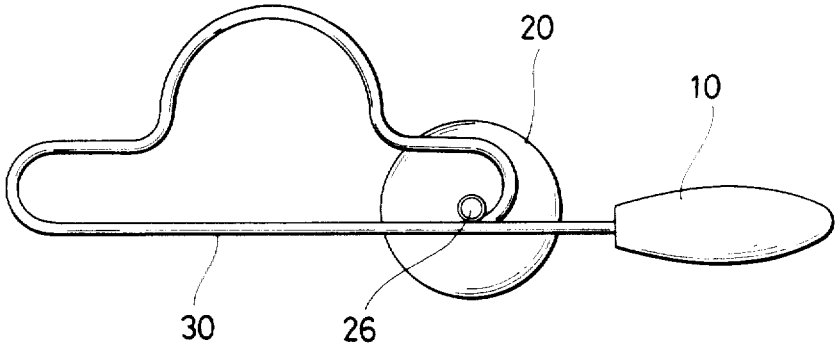
FIG. 10 is a side view, illustrating a seventh example of the rail according to the invention.

FIG. 9 illustrates still another embodiment of the present invention, wherein the free end 33 of the rail 30 is bent and smoothly connected to the portion close to the base of the grip 10 where the rail 30 is planted so as to form a loop of the rail 30. In this example, if the rotary shaft 26 of the wheel 20 is attracted to the inside of the rail 30, the wheel 20 will not spring out even when the grip 10 is rapidly oscillated. Moreover, the shape of the looped rail 30 can be changed freely as shown in FIG. 10.

As above described, in the shuttle wheel toy formed by planting a pair of essentially parallel, equally-long rails in a grip, folding back the rails halfway in a U shape, and providing extensions in portions close to where the rails are planted in order to roll and shuttle a wheel attracted to the rails by magnetized rotary shafts on the above rails by oscillating the grip, the grip contains a battery of which electrodes are connected to the rails through a switch, whereas the wheel contains a light emission element of which both terminals are connected to the conductive rotary shafts protruded from both sides of the wheel, and the wheel proper is formed with a light-permeable material so that visual variations may increase as the shuttle wheel rotates and this makes it effective to prevent players from quickly getting tired of playing with the shuttle wheel toy.

I claim:

1. A shuttle wheel amusement device comprising:

a pair of metal shuttle wheel support rails, said rails being substantially parallel and of equal length, and each of said rails having a basal end and a distal end;

a shuttle wheel disposed between and magnetically secured to said pair of metal shuttle wheel support rails, said shuttle wheel having a light permeable synthetic casing with substantially circular side walls projecting on either side of an imaginary surface extending from one of said support rails to the other of said support rails at corresponding points on said support rails, each of said side walls having an opening located in substantially the center of said side walls, a rotary shaft of sufficient length to contact and be magnetically supported by both of said shuttle wheel support rails, said rotary shaft being operable to move along said support rails when said support rails are tilted with respect to said rotary shaft, and said rotary shaft extending through each of said openings in said side walls, and a light emission element comprising a pair of light emission diodes of different colors positioned within said synthetic casing and anchored to said rotary shaft to turn about said rotary shaft and move with said shaft along said support rails; and a gripping means operable to be held and oscillated by hand motion, said gripping means comprising a pair of support rail openings operable to receive each of said basal ends of said shuttle wheel support rails, and a power supply and control assembly having a pair of metal terminals, each of said terminals contacted to an end of one of said shuttle wheel support rails, an on/off power switch, a pair of power cells positioned within said gripping means and operable to selectively impart a positive charge to one of said support rails and a negative charge to the other of said support rails, and a polarity changeover switch having a first position and a second position such that when said power switch is in an on position and said polarity changeover switch is in said first position only one of said light emission diodes is illuminated, and when said polarity changeover switch is in said second position only the other of said light emission diodes is illuminated.

2. A shuttle wheel amusement device comprising:

a pair of metal shuttle wheel support rails, said rails being substantially parallel and of equal length, and each of said rails having a basal end and a distal end;

a shuttle wheel disposed between and magnetically secured to said pair of metal shuttle wheel support rails, said shuttle wheel having a light permeable synthetic casing with substantially circular side walls projecting on either side of an imaginary surface extending from one of said support rails to the other of said support rails at corresponding points on said support rails, each of said side walls having an opening located in the center of each said side walls, a rotary shaft of sufficient length to contact and be magnetically supported by both of said shuttle wheel support rails, said rotary shaft being operable to move along said support rails when said support rails are tilted with respect to said rotary shaft, and said rotary shaft extending through each of said openings in said side walls, and a light emission element comprising a pair of light emission diodes of different colors positioned within said synthetic casing and anchored to said rotary shaft to turn about said rotary shaft and move with said rotary shaft along said support rail;

a grippping means operable to be held and oscillated by hand motion, said gripping means comprising:

a pair of support rail openings operable to receive each of said basel ends of said shuttle wheel support rails, and a power supply and control assembly having a pair of metal terminals, each of said terminals contacting an end of one of said shuttle wheel support rails, an on/off power switch, a pair of power cells positioned within said gripping means and operable to impart a positive charge to one of said support rails and a negative charge to the other of said support rails, and a polarity changeover switch having a first position and a second position; and an insulating portion overlaying the rotary shaft contact surface of at least one of said shuttle wheel support rails such that when said power switch is in said on position and said polarity changeover switch is in said first position and said rotary shaft is in contact with the metal surface of both of said shuttle wheel support rails, an electrical circuit will be completed and one of said light emission diodes will be illuminated, and when said polarity changeover switch is in said second position only the other of said light emission diodes is illuminated, but when said rotary shaft is in contact with said insulating portion of said support rail the electrical circuit will be broken and none of said light emission diodes will be illuminated.

3. A shuttle wheel amusement device as recited in claims 1 or 2 further characterized in that:

said pair of metal shuttle wheel support rails are U-shaped.

4. A shuttle wheel amusement device as recited in claims 1 or 2 further characterized in that:

said pair of metal shuttle wheel support rails are channel steel rails wherein the openings of each rail face each other.

5. A shuttle wheel amusement device as recited in claims 1 or 2 further characterized in that:

said pair of metal shuttle wheel support rails are looped-shaped.

* * * * *